United States Patent [19]

Smith et al.

[11] 4,100,034

[45] Jul. 11, 1978

[54] QUENCHING METHOD

[75] Inventors: Jimmy B. Smith, Columbia; Jack R. Haley, Nashville, both of Tenn.

[73] Assignee: Peabody Coal Company, Columbia, Tenn.

[21] Appl. No.: 706,436

[22] Filed: Jul. 19, 1976

[51] Int. Cl.[2] ..... C10B 39/04

[52] U.S. Cl. ..... 201/39; 202/227; 202/228; 266/122; 266/195; 432/85

[58] Field of Search ..... 201/39; 202/95, 227, 202/228, 230; 432/85; 34/13, 65; 110/171; 266/122, 195

[56] References Cited

U.S. PATENT DOCUMENTS

| | | | |
|---|---|---|---|
| 3,589,317 | 6/1971 | Kunovits | 110/171 |
| 3,850,616 | 11/1974 | Cruse, Jr. | 266/195 X |
| 3,988,211 | 10/1976 | Lewandowski et al. | 201/39 X |

FOREIGN PATENT DOCUMENTS

| | | | |
|---|---|---|---|
| 83,447 | 7/1920 | Fed. Rep. of Germany | 202/228 |
| 348,207 | 5/1931 | United Kingdom | 202/227 |

*Primary Examiner*—Morris O. Wolk
*Assistant Examiner*—Arnold Turk
*Attorney, Agent, or Firm*—Littlepage, Quaintance, Murphy, Richardson and Webner

[57] ABSTRACT

A column of hot, particulate char from a shaft furnace is moistened with quench water as it moves downwardly into a vessel which it fills and forms a pile. The material in the pile is shifted from a central core at the base of the column to a zone which surrounds the sides and bottom of the column by material flowing from the lower portion of the column; and steam is exhausted from the upper portion of the vessel.

2 Claims, 1 Drawing Figure

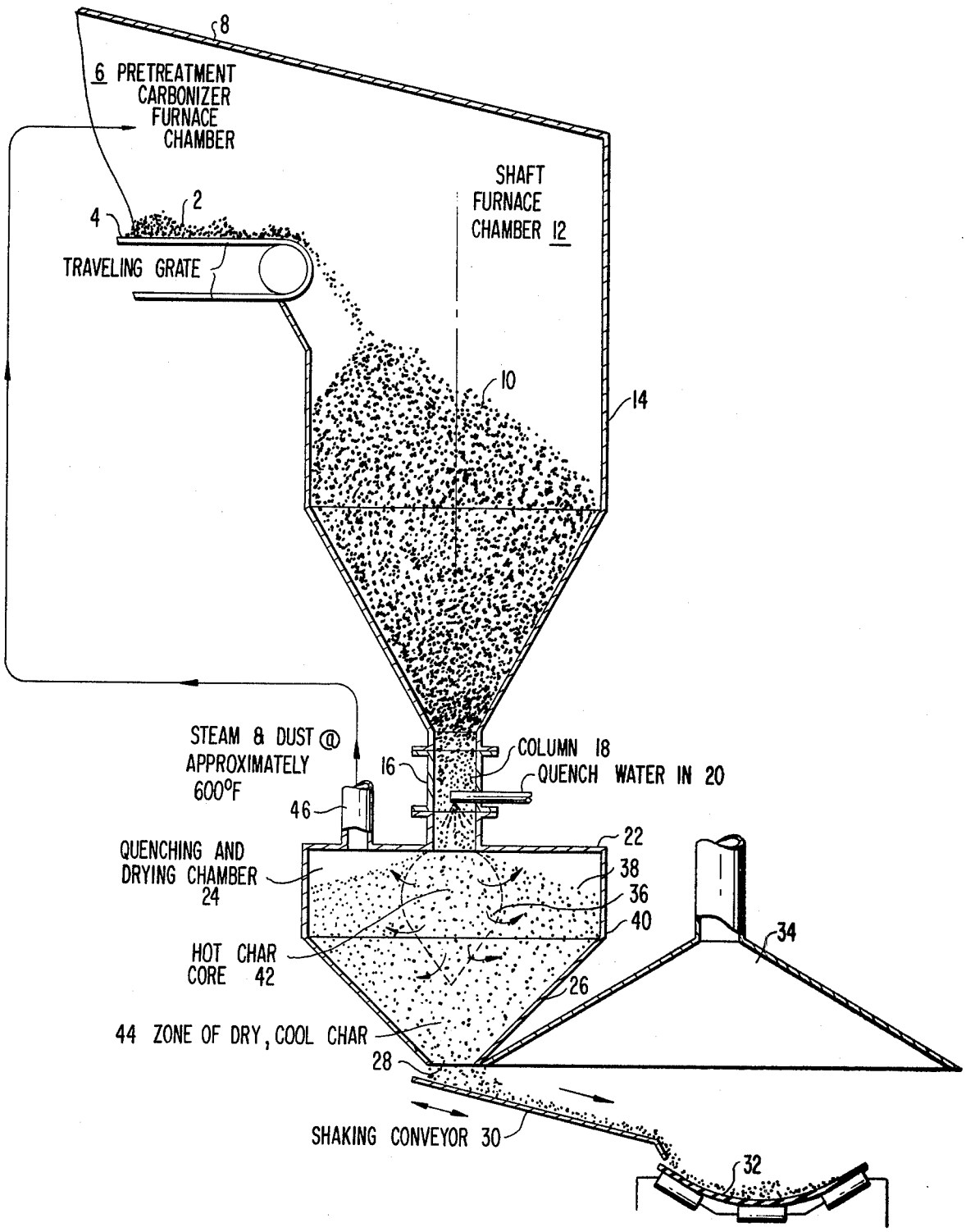
8
6 PRETREATMENT CARBONIZER FURNACE CHAMBER
SHAFT FURNACE CHAMBER 12
2
4
TRAVELING GRATE
10
14
STEAM & DUST @ APPROXIMATELY 600°F
16
COLUMN 18
QUENCH WATER IN 20
46
22
QUENCHING AND DRYING CHAMBER 24
38
36
40
34
HOT CHAR CORE 42
26
44 ZONE OF DRY, COOL CHAR
28
SHAKING CONVEYOR 30
32

QUENCHING METHOD

FIELD OF INVENTION

Distillation Apparatus, Quencher.

PRIOR ART

Bretz U.S. Pat. Nos. 3,591,462, Hagstrom 3,839,157.

OBJECTS

Heretofore char has been produced in a moving grate stoker furnace and deposited into a downwardly-moving column in a shaft furnace. Because the char is hot and flammable, it must be quenched before it can be exposed to the atmosphere. This can be accomplished by drenching the char with sufficient water to cool it, but this is likely to result in an overly-wet, soggy mass from which excess water must subsequently be dried or extracted. The object now is to provide a method and apparatus wherein quench water is injected in a downwardly moving column of hot char which digresses into a quench chamber in which the volume and mass of char becomes larger, the result being that, as the mass enlarges, there is a central core of hot steamcharged char which, as it cools, migrates outwardly and downwardly from the core, giving off moisture in the form of steam which is exhausted from the quench chamber back into the furnace chamber.

These and other objects will be apparent from the following specification and drawing, in which the sole FIGURE is a diagrammatic cross-section through the apparatus, illustrating the method.

Prior to the quenching process, a layer of crushed-non-coking coal is introduced onto a traveling grate 4, upon which it is transported through the chamber 6 of a pretreatment carbonizer furnace 8, only the rear end of which is diagrammatically illustrated. The portion of the charring process performed in the pretreatment carbonizer furnace is generally similar to that performed in the chain grate stoker furnace disclosed in Hagstrom (supra), it being understood that the grate 4 moves over airbox zones (not shown) with only limited amounts of air being admitted to the coal and a reducing atmosphere being maintained in the furnace chamber above the bed. For purposes of understanding this invention, it is sufficient to note that as the char drops off the end of chain grate 4, it is incandescent, highly reactive with oxygen, and it still retains some volatile matter, most of which is driven off by the residual heat therein as it forms a downwardly moving mass 10 in the chamber 12 of shaft furnace 14.

The lower sidewalls of the shaft furnace converge downwardly to a substantially vertical outlet pipe 16 whose cross sectional area is greatly reduced as compared with the cross sectional area of the shaft furnace. Thus the still-hot and loose char emerging from the shaft furnace forms a downwardly moving column 18 in pipe 16. Quench water is injected into column 18 via nozzle 20, which preferably is centrally located in pipe 16, and which moistens a portion of the column.

Beneath outlet pipe 16 is a vessel 22 which encloses a quenching and drying chamber 24 enlarged laterally and downwardly from the lower end of outlet pipe 16. Vessel 22 has a frusto-conical lower side wall 26 with a bottom outlet opening 28. Char emerging through outlet opening 28 is deposited upon a conveyor 30 which moves it to a char collection conveyor 32 under a dust hood 34. The downwardly emerging char chokes opening 28 so that a pile 36 of the char builds up within the quenching and drying chamber until it reaches the lower end of pipe 16, and the upper surface 38 of pile 36 forms an angle of repose which extends outwardly and downwardly from the lower end of pipe 16 to the side wall 40 so that the upper central portion of the pile chokes the lower end of pipe 16. The rate at which conveyor 30 is operated controls the choke-release of outlet 28 and hence the choke release of pipe 16, and therefore the rate at which the char moves downwardly in column 18 and the residence time of the char in the quenching and drying chamber 24 is controlled. This, in turn, controls the upper limits of the temperature and moisture content of the char discharging through opening 28. The conveyor 30 is designated in the drawing as a "shaking conveyor". This is illustrative of various types of conventional conveyors that can be used to control the choke-release of outlet 28.

The quench water injected into column 18 via nozzle 20 immediately turns to steam and blasts downwardly to form a hot steam drenched core 42 beneath the lower end of column 18, which core is surrounded at its sides and bottom by a zone 44 of dry, cool char. Steam and dust at approximately 600° F is exhausted from the upper portion of the quenching and drying chamber 24 and returned to the chamber 6 of the pretreatment carbonizer furnace. As the steam moves outwardly from core 42 into the surrounding zone 44, residual heat in the char in the surrounding zone is given up and the moisture, in the form of superheated steam, is removed. The char, of course, shifts constantly from the hot steam-moistened core 42 into the surrounding zone 44 as the material of the pile moves downwardly through the quenching and drying chamber 24.

For chars made of high ranking coals, such as anthracite, the temperature at the point of emergence into the atmosphere, such as at outlet opening 28, can be as high as about 350° F, assuming a moisture content of about one half of one percent. For highly reactive chars made of lower ranked coals, the temperature when exposed to the atmosphere should not, in some cases, be more than about 150° F, assuming a moisture content of about one to three percent.

A slightly positive pressure is maintained within the quenching and drying chamber 24 so as to preclude the entrance of air into the chamber. If needed, a damper can be used in exhaust pipe 46. Although the invention applies to char quenching, it may be used for quenching and drying other hot materials whose upper limits of temperature and moisture content must be controlled.

From the foregoing, it will be apparent that quenching is accomplished without any moving parts. The cooling is accomplished by evaporating water, and superheating the saturated steam, although it may be enhanced by loss of heat through the walls of the quench chamber. Furthermore, air is eliminated from the quench chamber.

I claim:

1. A process for quenching loose, hot char material which comprises:

gravity feeding a column of downwardly moving hot char material in a substantially vertical pipe, collecting said material in a vessel having an outlet opening in a lower portion thereof by feeding said column of material into a top portion of said vessel, forming a pile of said material in said vessel which pile extends upwardly to and chokes the bottom of the pipe, feeding quench water into said column of material forming a hot steam drenched core portion beneath the column and extending within the vessel adjacent said top portion and exhausting steam from an upper portion of said vessel while discharging said material through said outlet opening at a rate to obtain a desired residence time of said material in said pipe and vessel so as to control the temperature and moisture content of the discharging material, whereby the material in the column and core portion is cooled and quenched by the quench water and moisture is driven off from the material in the pile by the residual heat therein.

2. The process recited in claim 1, wherein the hot char material is a non-coking carbonaceous material.

* * * * *